US010358874B2

(12) United States Patent
Can et al.

(10) Patent No.: US 10,358,874 B2
(45) **Date of Patent: *Jul. 23, 2019**

(54) POLYCRYSTALLINE DIAMOND STRUCTURE

(71) Applicant: Element Six Abrasives S.A., Luxembourg (LU)

(72) Inventors: Nedret Can, Oxfordshire (GB); Thembinkosi Shabalala, Springs (ZA)

(73) Assignee: ELEMENT SIX ABRASIVES S.A., Luxembourg (LU)

( * ) Notice: Subject to any disclaimer, the term of this patent is extended or adjusted under 35 U.S.C. 154(b) by 0 days.

This patent is subject to a terminal disclaimer.

(21) Appl. No.: 15/696,335

(22) Filed: Sep. 6, 2017

(65) Prior Publication Data

US 2018/0023348 A1 Jan. 25, 2018

Related U.S. Application Data

(63) Continuation of application No. 14/115,747, filed as application No. PCT/EP2012/058659 on May 10, 2012, now abandoned.

(Continued)

(30) Foreign Application Priority Data

May 10, 2011 (GB) ..... 1107764.1

(51) Int. Cl.
*B24D 99/00* (2010.01)
*B24D 3/34* (2006.01)

(Continued)

(52) U.S. Cl.
CPC ..... *E21B 10/567* (2013.01); *B24D 3/008* (2013.01); *B24D 3/34* (2013.01); *B24D 99/005* (2013.01);

(Continued)

(58) Field of Classification Search
CPC .... E21B 10/55; E21B 10/567; E21B 10/5735; E21C 35/183; E21C 2035/1816
See application file for complete search history.

(56) References Cited

U.S. PATENT DOCUMENTS 5,135,061 A 8/1992 Newton, Jr.
5,147,687 A 9/1992 Garg et al.

(Continued)

FOREIGN PATENT DOCUMENTS

CN 101395335 3/2009
DE 10027427 2/2002

(Continued)

OTHER PUBLICATIONS

Lammer, Mechanical properties of polycrystalline diamonds, Materials Science and Technology, 4:949 1988.

(Continued)

*Primary Examiner* — Pegah Parvini
(74) *Attorney, Agent, or Firm* — Bryan Cave Leighton Paisner LLP

(57) ABSTRACT

A PCD structure comprises a first region and a second region adjacent the first region, the second region being bonded to the first region by intergrowth of diamond grains; the first region comprising a plurality of alternating strata or layers, each stratum or layer having a thickness in the range of around 5 to 300 microns. The second region comprises a plurality of strata or layers, one or more strata or layers in the second region having a thickness greater than the thicknesses of the individual strata or layers in the first region. The alternating layers or strata in the first region comprise first layers or strata alternating with second layers or strata, the first layers or strata being in a state of residual compressive stress and the second layers or strata being in a state of residual tensile stress.

25 Claims, 6 Drawing Sheets

Related U.S. Application Data

(60) Provisional application No. 61/484,556, filed on May 10, 2011.

(51) Int. Cl.

| | |
|---|---|
| ***B24D 3/00*** | (2006.01) |
| ***E21B 10/55*** | (2006.01) |
| ***E21B 10/567*** | (2006.01) |
| ***E21B 10/573*** | (2006.01) |
| ***E21C 35/183*** | (2006.01) |
| *E21C 35/18* | (2006.01) |

(52) U.S. Cl.

CPC ..... *E21B 10/55* (2013.01); *E21B 10/5735* (2013.01); *E21C 35/183* (2013.01); *E21C 2035/1816* (2013.01)

(56) References Cited

U.S. PATENT DOCUMENTS

| | | | |
|---|---|---|---|
| 5,766,394 | A | 6/1998 | Anderson et al. |
| 6,446,740 | B2 | 9/2002 | Eyre |
| 6,521,174 | B1 | 2/2003 | Butcher et al. |
| 7,694,757 | B2 | 4/2010 | Keshavan |
| 2003/0131787 | A1 | 7/2003 | Linares et al. |
| 2004/0111159 | A1 | 6/2004 | Pope et al. |
| 2006/0191723 | A1 | 8/2006 | Keshavan |
| 2009/0273224 | A1 | 11/2009 | Hall |
| 2010/0108403 | A1 | 5/2010 | Keshavan |
| 2010/0294571 | A1 | 11/2010 | Belnap et al. |
| 2011/0132667 | A1 | 6/2011 | Smallman et al. |

FOREIGN PATENT DOCUMENTS

| | | |
|---|---|---|
| GB | 2261894 | 6/1993 |
| GB | 2334984 | 9/1999 |
| WO | 2007089590 | 8/2007 |
| WO | 2009125355 | 10/2009 |
| WO | 2011069637 A1 | 6/2011 |

OTHER PUBLICATIONS

Miess et al., Fracture toughness and thermal resistances of polycrystalline diamond compacts, Materials Science and Engineering, A209(1 to 2): 270-276 1996.

Munz et al., Ceramics, mechanical properties, failure behaviour, materials selections, Springer, Berlin 1999.

Patent Cooperation Treaty, International Search Report for PCT/EP2012/058659 dated 2013.

United Kingdom Patent Office; Search Report for GB1208157.6 dated 2012.

United Kingdom Patent Office; Search Report for GB1107764.1 dated 2011.

POLYCRYSTALLINE DIAMOND STRUCTURE

FIELD

This disclosure relates to a polycrystalline diamond (PCD) structure, elements comprising the same, methods for making the same and tools comprising the same, particularly but not exclusively for use in rock degradation or drilling, or for boring into the earth.

BACKGROUND

PCD material comprises a mass of substantially intergrown diamond grains and interstices between the diamond grains. PCD may be made by subjecting an aggregated mass of diamond grains to an ultra-high pressure and temperature in the presence of a sintering aid such as cobalt, which may promote the inter-growth of diamond grains. The sintering aid may also be referred to as a catalyst material for diamond. Interstices within the PCD material may be wholly or partially filled with residual catalyst material. PCD may be integrally formed on and bonded to a cobalt-cemented tungsten carbide substrate, which may provide a source of cobalt catalyst material for sintering the PCD. As used herein, the term "integrally formed" regions or parts are produced contiguous with each other and are not separated by a different kind of material. Tool inserts comprising PCD material are widely used in drill bits used for boring into the earth in the oil and gas drilling industry. Although PCD material is extremely abrasion resistant, there is a need for PCD tool inserts that have enhanced fracture resistance.

SUMMARY

Viewed from a first aspect, there is provided a PCD structure comprising a first region and a second region adjacent the first region, the second region being bonded to the first region by intergrowth of diamond grains; the first region comprising a plurality of alternating strata or layers, each stratum or layer having a thickness in the range of around 5 to 300 microns; the second region comprising a plurality of strata or layers, one or more strata or layers in the second region having a thickness greater than the thicknesses of the individual strata or layers in the first region, wherein the alternating layers or strata in the first region comprise first layers or strata alternating with second layers or strata, the first layers or strata being in a state of residual compressive stress and the second layers or strata being in a state of residual tensile stress.

In some embodiments, the strata or layers in the first region may have a thickness or thicknesses in the range of, for example, around 30 to 300 microns, or 30 to 200 microns.

The strata or layers in the second region may have a thickness, for example, of greater than around 200 microns.

In some embodiments, the first region may comprise two or more different average diamond grain sizes, and in other embodiments the first region may comprise three of more different average diamond grain sizes.

Viewed from a second aspect, there is provided a PCD structure comprising a first region and a second region adjacent the first region, the second region being bonded to the first region by intergrowth of diamond grains; the first region comprising a plurality of alternating strata or layers, each layer or stratum in the first region having a thickness in the range of around 5 to 300 microns; the first region comprising two or more different average diamond grain sizes.

In some embodiments, the first region may comprise three or more different average diamond grain sizes.

Viewed from a third aspect there is provided a PCD structure comprising a first region and a second region adjacent the first region, the second region being bonded to the first region by intergrowth of diamond grains; the first region comprising a plurality of alternating strata or layers, each stratum or layer having a thickness in the range of around 5 to 300 microns.

In some embodiments, each stratum or layer in the first and/or second region may have a substantially uniform diamond grain size distribution throughout said stratum or layer.

In some embodiments, the first region may comprise an external working surface forming the initial working surface of the PCD structure in use.

In some embodiments, each stratum or layer in the first region may have a thickness in the range of around 30 to 300 microns.

In some embodiments, the alternating layers or strata comprise first layers or strata alternating with second layers or strata, the first layers or strata being in a state of residual compressive stress and the second layers or strata being in a state of residual tensile stress In some embodiments, the second region comprises a plurality of layers or strata comprising diamond grains of a predetermined average grain size.

The predetermined average grain size of the diamond grains in the second region may, for example, be one of the average grain sizes of the diamond grains in the mix of diamond grain in the first region.

In some embodiments, the alternating layers or strata comprise first layers or strata alternating with second layers or strata, the first layers or strata being formed of a diamond mix having three or more different average diamond grain sizes and the second layers or strata being formed of a diamond mix having the same three or more average diamond grain sizes average grain size or sizes, wherein the first strata or layers in the first region have a different ratio of diamond grain sizes in said mix from the second strata or layers in the first region.

In some embodiments, the alternating layers or strata comprise first layers or strata alternating with second layers or strata, the first layers or strata being formed of a diamond mix having a first average grain size or sizes and the second layers or strata being formed of a diamond mix having a second average grain size or sizes.

The layers or strata in the first region and/or the second region may further comprise one or more of nanodiamond additions in the form of nanodiamond powder up to 20 wt %, salt systems, borides, metal carbides of Ti, V, Nb or any of the metals Pd or Ni.

In some embodiments, at least a portion of the first region is substantially free of a catalyst material for diamond, said portion forming a thermally stable region. The thermally stable region may extend, for example, a depth of at least 50 microns from a surface of the PCD structure; in some embodiments, the thermally stable region may comprise, for example, at most 2 weight percent of catalyst material for diamond.

A PCD element comprising the above PCD structure bonded to a cemented carbide support body may be provided, as well as a tool comprising such a PCD element. The tool may, for example, be a drill bit or a component of a drill bit for boring into the earth, or a pick or an anvil for degrading or breaking hard material such as asphalt or rock.

BRIEF DESCRIPTION OF THE DRAWINGS

Examples of PCD structures will now be described with reference to the accompanying drawings, in which.

Figure 1:
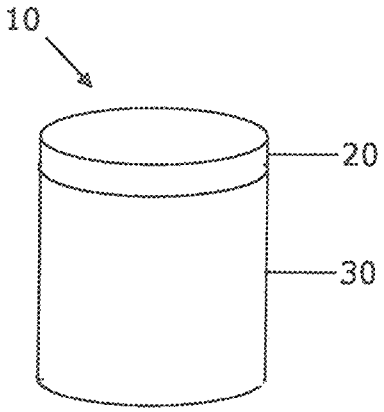
FIG. 1 shows a schematic perspective view of an example PCD cutter element for a drill bit for boring into the earth.

The same references refer to the same general features in all the drawings.

DESCRIPTION

As used herein, polycrystalline diamond (PCD) is a super-hard material comprising a mass of diamond grains, a substantial portion of which are directly inter-bonded with each other and in which the content of diamond is at least about 80 volume percent of the material. In one embodiment of PCD material, interstices between the diamond gains may be at least partly filled with a binder material comprising a catalyst for diamond. As used herein, "interstices" or "interstitial regions" are regions between the diamond grains of PCD material. In examples of PCD material, interstices or interstitial regions may be substantially or partially filled with a material other than diamond, or they may be substantially empty. Examples of PCD material may comprise at least a region from which catalyst material has been removed from the interstices, leaving interstitial voids between the diamond grains. As used herein, a catalyst material for diamond is a material capable of promoting the direct intergrowth of diamond grains.

As used herein, a PCD grade is a PCD material characterised in terms of the volume content and size of diamond grains, the volume content of interstitial regions between the diamond grains and composition of material that may be present within the interstitial regions. A grade of PCD material may be made by a process including providing an aggregate mass of diamond grains having a size distribution suitable for the grade, optionally introducing catalyst material or additive material into the aggregate mass, and subjecting the aggregated mass in the presence of a source of catalyst material for diamond to a pressure and temperature at which diamond is more thermodynamically stable than graphite and at which the catalyst material is molten. Under these conditions, molten catalyst material may infiltrate from the source into the aggregated mass and is likely to promote direct intergrowth between the diamond grains in a process of sintering, to form a PCD structure. The aggregate mass may comprise loose diamond grains or diamond grains held together by a binder material and said diamond grains may be natural or synthesised diamond grains.

Different PCD grades may have different microstructures and different mechanical properties, such as elastic (or Young's) modulus E, modulus of elasticity, transverse rupture strength (TRS), toughness (such as so-called $K_1C$ toughness), hardness, density and coefficient of thermal expansion (CTE). Different PCD grades may also perform differently in use. For example, the wear rate and fracture resistance of different PCD grades may be different.

The table below shows approximate compositional characteristics and properties of three example PCD grades referred to as PCD grades I, II and III. All of the PCD grades may comprise interstitial regions filled with material comprising cobalt metal, which is an example of catalyst material for diamond.

| | PCD grade I | PCD grade II | PCD grade III |
|---|---|---|---|
| Mean grain size, microns | 7 | 11 | 16 |
| Catalyst content, vol. % | 11.5 | 9.0 | 7.5 |
| TRS, MPa | 1,880 | 1,630 | 1,220 |
| $K_1C$, MPa · $m^{1/2}$ | 10.7 | 9.0 | 9.1 |
| E, GPa | 975 | 1,020 | 1,035 |
| CTE, $10^{-6}$ mm/° C. | 4.4 | 4.0 | 3.7 |

With reference to FIG. 1, an example of a PCD element 10 comprises a PCD structure 20 bonded or otherwise joined to a support body 30, which may comprise cemented tungsten carbide material. The PCD structure 20 comprises one or more PCD grades.

As used herein, the term "stress state" refers to a compressive, unstressed or tensile stress state. Compressive and tensile stress states are understood to be opposite stress states from each other. In a cylindrical geometrical system, the stress states may be axial, radial or circumferential, or a net stress state.

Figure 2:
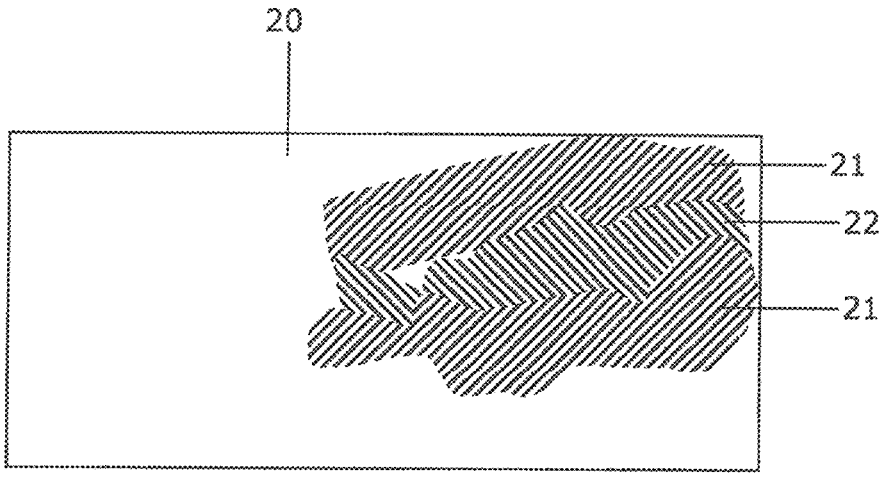
FIG. 2 shows a schematic cross-section view of an example of a portion of a PCD structure.

With reference to FIG. 2, an example of a PCD structure 20 comprises at least two spaced-apart compressed regions 21 in compressive residual stress states and at least one tensioned region 22 in a tensile residual stress state. The tensioned region 22 is located between the compressed regions 21 and is joined to them.

Variations in mechanical properties of the PCD material such as density, elastic modulus, hardness and coefficient of thermal expansion (CTE) may be selected to achieve the configuration of a tensioned region between two compressed regions. Such variations may be achieved by means of variations in content of diamond grains, content and type of filler material, size distribution or mean size of the PCD grains, and using different PCD grades either on their own or in diamond mixes comprising a mixture of PCD grades.

Figure 3:
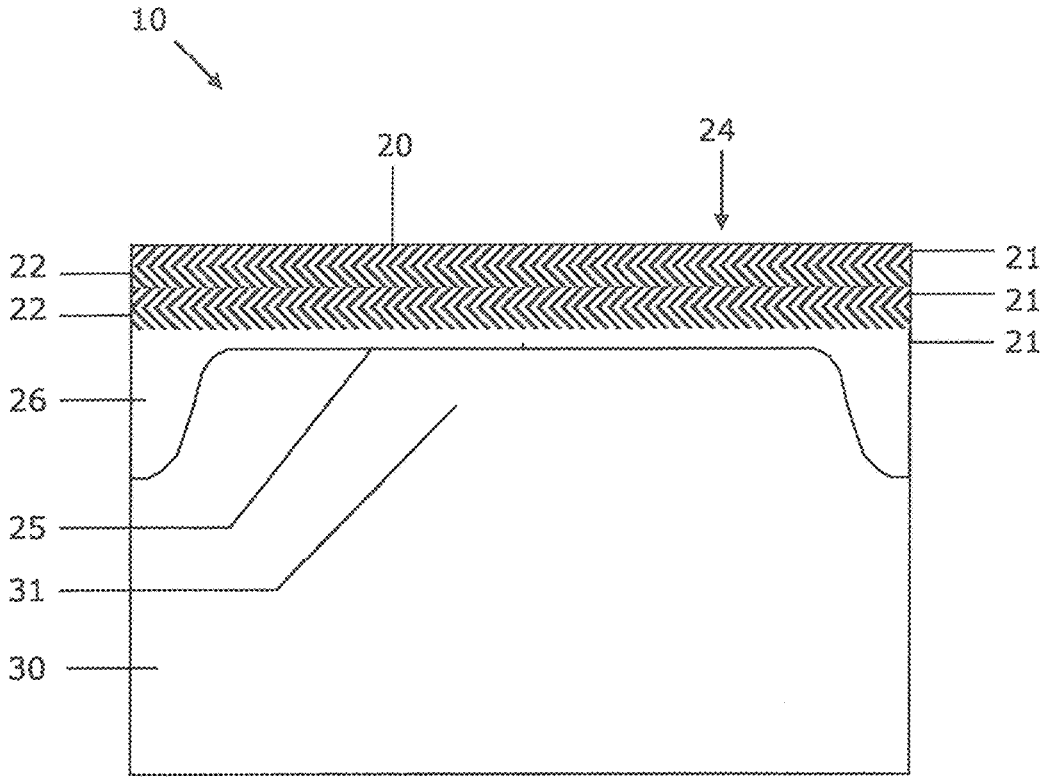
FIG. 3 shows a schematic longitudinal cross-section view of an example of a PCD element.

With reference to FIG. 3, an example of a PCD element 10 comprises a PCD structure 20 integrally joined to a cemented carbide support body 30. The PCD structure 20 comprises several compressed regions 21 and several tensioned regions 22 in the form of alternating (or inter-leaved) strata or layers. The PCD element 10 may be substantially cylindrical in shape, with the PCD structure 20 located at a working end and defining a working surface 24. The PCD structure 20 may be joined to the support body 30 at a non-planar interface 25. The compressed and tensioned regions 21, 22 have a thickness in the range from about 30 microns to about 200 or, in some embodiments, 300 microns and may be arranged substantially parallel to the working surface 24 of the PCD structure 20. A substantially annular region 26 may be located around a non-planar feature 31 projecting from the support body 30. In some embodiments, the annular region 26 comprises PCD grade II, the tensioned regions 22 comprise PCD grade II and the compressed regions 21 comprise PCD grade III.

Figure 4:
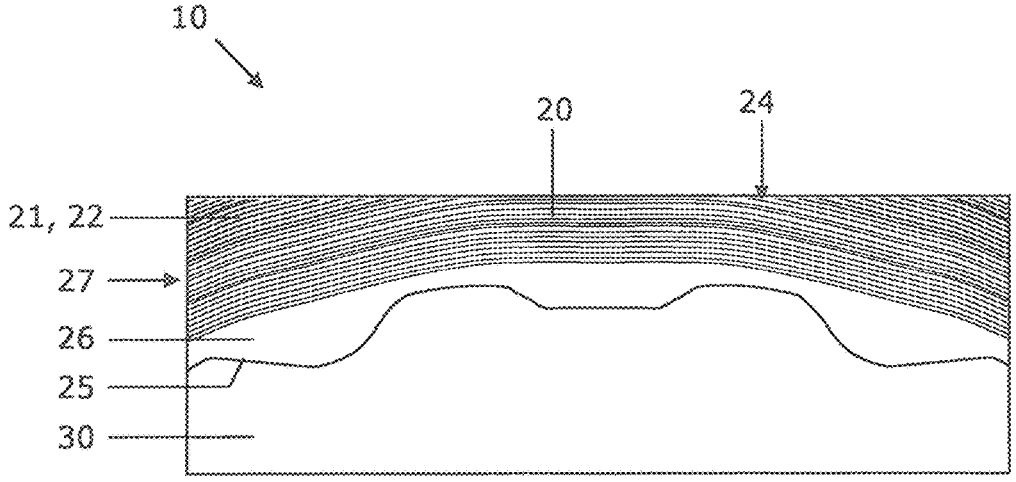
FIG. 4 shows a schematic longitudinal cross-section view of an example of a PCD element.

With reference to FIG. 4, an example of a PCD element 10 comprises a PCD structure 20 integrally joined to a cemented carbide support body 30 at a non-planar interface 25 opposite a working surface 24 of the PCD structure 20. The PCD structure 20 may comprise about 10 to 20 alternating compressed and tensioned regions 21, 22 in the form of extended strata or layers. A region 26 that, in this embodiment, does not contain strata may be located adjacent the interface 25. The strata 21, 22 may be curved or bowed and yet generally aligned with the interface 25, and may intersect a side surface 27 of the PCD structure. Some of the strata may intersect the working surface 24.

In some embodiments, the region 26 may be of a substantially greater thickness than the individual strata or layers 21, 22 and, in some embodiments, the thickness of the region comprising the alternating layers 21, 22 may be of a greater thickness than the thickness of the region 26 adjacent the cemented carbide support body 30 which forms a substrate for the PCD material.

In some embodiments, the region 26 adjacent the support body 30 may include multiple layers or strata (not shown) that are of substantially greater thickness than the individual layers or strata 21, 22, for example, the layers 21, 22 may have a thickness in the range from about 30 to 200 microns, and the layers in the region 26 adjacent the support body 30 may have a thickness of greater than about 200 microns.

In some embodiments, the tensioned regions 22 may comprise PCD grade I and the compressed regions 22 may comprise PCD grade III. In another variant, the tensioned regions 22 may comprise PCD grade II and the compressed regions 22 comprise PCD grade III.

In some embodiments, such as those shown in FIGS. 1 to 4, the alternating strata, 21, 22 may have a thickness or thicknesses in the range of from about 30 to 300 microns with the diamond material being formed of PCD with three or more different average diamond grain sizes. For example, strata 21 may be formed of a diamond mix having average diamond grain sizes A, B and C and strata 22 may also be formed of a diamond mix having average diamond grain sizes A, B and C but in a different ratio to that of strata 21. In an alternative embodiment, the strata 21 may be formed of a diamond mix having average diamond grain sizes A and B and the strata 22 may be formed of a diamond mix having an average diamond grain size C. It will be appreciated that any other sequence/mixture of three or more diamond grain sizes may be used to form the alternating layers 21, 22. In these embodiments, the region 26 adjacent the support body 30 may be formed of a single layer substantially thicker than the individual strata 21, 22, for example, greater than around 200 microns. Alternatively, the region 26 may be formed of multiple layers, individual layers or strata comprising diamond grains of average grain size A, B, or C as used to form the diamond mixes of the strata 21, 22 or another material or diamond grain size may be used to form the layers in this region 26 adjacent the support body 30.

In some embodiments, the diamond layers or strata 21, 22 and/or strata formed in region 26 adjacent the support body 30 (not shown), may include, for example, one or more of nanodiamond additions in the form of nanodiamond powder up to 20 wt %, salt systems, borides, metal carbides of Ti, V, Nb or any of the metals Pd or Ni.

In some embodiments, the strata 21, 22 and/or strata formed in region 26 adjacent the support body 30 may lie in a plane substantially perpendicular to the plane through which the longitudinal axis of the diamond construction 10 extends. The strata may be planar, curved, bowed, domed or distorted, for example, as a result of being subjected to ultra-high pressure during sintering. Alternatively, the alternating strata 21, 22 may be aligned at a predetermined angle to the plane through which the longitudinal axis of the diamond construction 10 extends to influence performance through crack propagation control.

Figure 5:
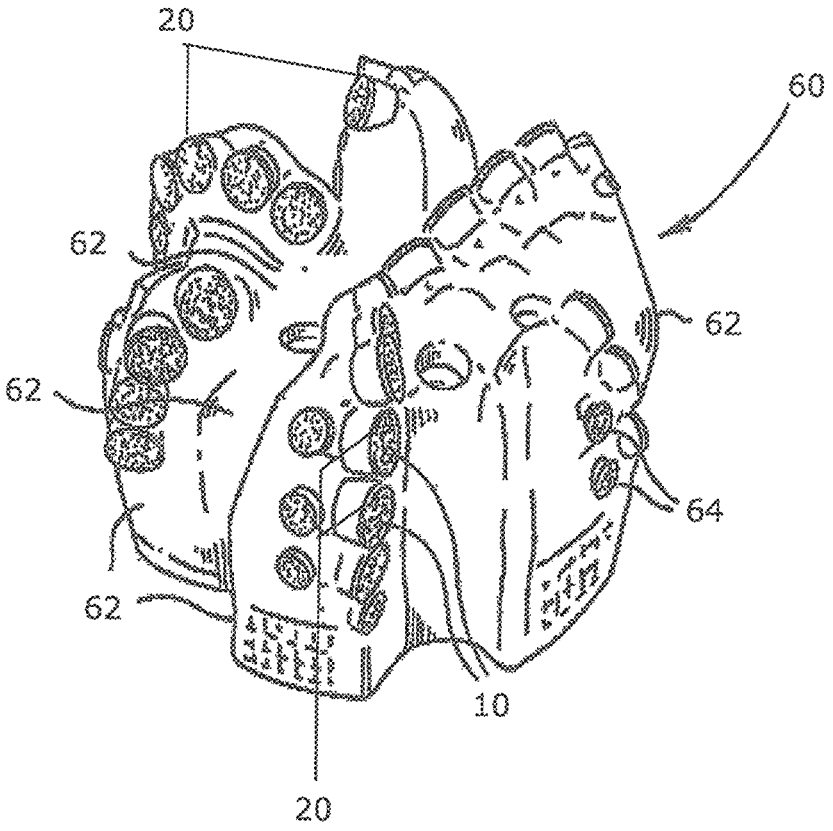
FIG. 5 shows a schematic perspective view of part of an example of a drill bit for boring into the earth.

With reference to FIG. 5, an example of a drill bit 60 for drilling into rock (not shown) is shown as comprising example PCD elements 10 mounted onto a bit body 62. The PCD elements 10 are arranged so that the respective PCD structures 20 project from the bit body 62 for cutting the rock.

An example method for making a PCD element is now described. Aggregate masses in the form of sheets containing diamond grains held together by a binder material may be provided. The sheets may be made by a method known in the art, such as by extrusion or tape casting methods, in which slurries comprising diamond grains having respective size distributions suitable for making the desired respective PCD grades, and a binder material is spread onto a surface and allowed to dry. Other methods for making diamond-containing sheets may also be used, such as described in U.S. Pat. Nos. 5,766,394 and 6,446,740. Alternative methods for depositing diamond-bearing layers include spraying methods, such as thermal spraying. The binder material may comprise a water-based organic binder such as methyl cellulose or polyethylene glycol (PEG) and different sheets comprising diamond grains having different size distributions, diamond content or additives may be provided. For example, at least two sheets comprising diamond having different mean sizes may be provided and first and second sets of discs may be cut from the respective first and second sheets. The sheets may also contain catalyst material for diamond, such as cobalt, and/or additives for inhibiting abnormal growth of the diamond grains or enhancing the properties of the PCD material. For example, the sheets may contain about 0.5 weight percent to about 5 weight percent of vanadium carbide, chromium carbide or tungsten carbide. In one example, each of the sets may comprise about 10 to 20 discs.

A support body comprising cemented carbide in which the cement or binder material comprises a catalyst material for diamond, such as cobalt, may be provided. The support body may have a non-planar end or a substantially planar proximate end on which the PCD structure is to be formed and which forms the interface. A non-planar shape of the end may be configured to reduce undesirable residual stress between the PCD structure and the support body. A cup may be provided for use in assembling the diamond-containing sheets onto the support body. The first and second sets of discs may be stacked into the bottom of the cup in alternating order. In one version of the method, a layer of substantially loose diamond grains may be packed onto the uppermost of the discs. The support body may then be inserted into the cup with the proximate end going in first and pushed against the substantially loose diamond grains, causing them to move slightly and position themselves according to the shape of the non-planar end of the support body to form a pre-sinter assembly.

The pre-sinter assembly may be placed into a capsule for an ultra-high pressure press and subjected to an ultra-high pressure of at least about 5.5 GPa and a high temperature of at least about 1,300 degrees centigrade to sinter the diamond grains and form a PCD element comprising a PCD structure integrally joined to the support body. In one version of the method, when the pre-sinter assembly is treated at the ultra-high pressure and high temperature, the binder material within the support body melts and infiltrates the strata of diamond grains. The presence of the molten catalyst material from the support body is likely to promote the sintering of the diamond grains by intergrowth with each other to form an integral, stratified PCD structure.

In some versions of the method, the aggregate masses may comprise substantially loose diamond grains, or diamond grains held together by a binder material. The aggregate masses may be in the form of granules, discs, wafers or sheets, and may contain catalyst material for diamond and/or additives for reducing abnormal diamond grain growth, for example, or the aggregated mass may be substantially free of catalyst material or additives. In one version, the first mean size may be in the range from about 0.1 micron to about 15 microns, and the second mean size may be in the range from about 10 microns to about 40 microns. In one version, the aggregate masses may be assembled onto a cemented carbide support body.

Figure 6A:
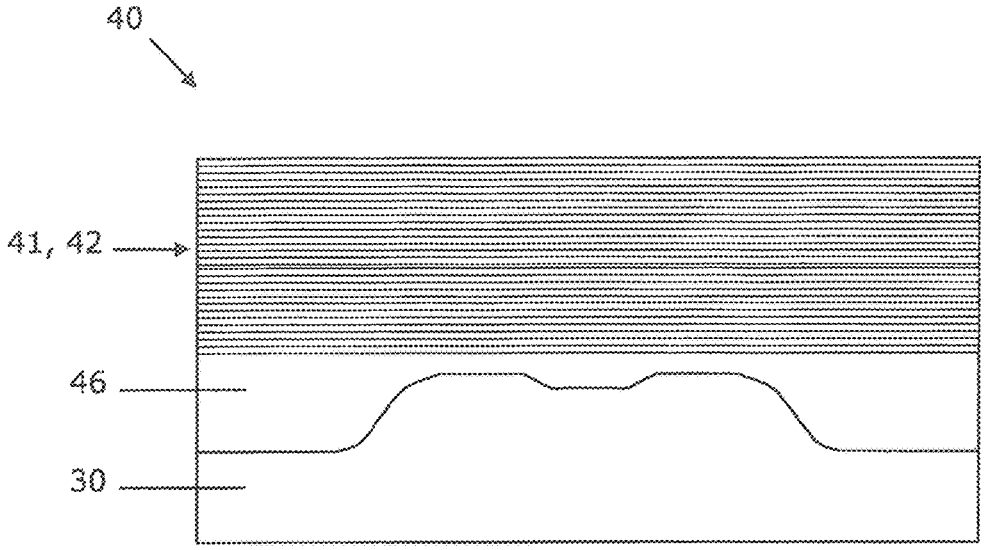
FIG. 6A shows a schematic longitudinal cross-section view of an example of a pre-sinter assembly for a PCD element.

With reference to FIG. 6A, an example of a pre-sinter assembly 40 for making a PCD element may comprise a support body 30, a region 46 comprising diamond grains packed against a non-planar end of the support body 30, and a plurality of alternating diamond-containing aggregate masses in the general form of discs or wafers 41, 42 stacked on the region 46. In some versions, the aggregate masses may be in the form of loose diamond grains or granules. The pre-sinter assembly may be heated to remove the binder material comprised in the stacked discs.

Figure 6B:
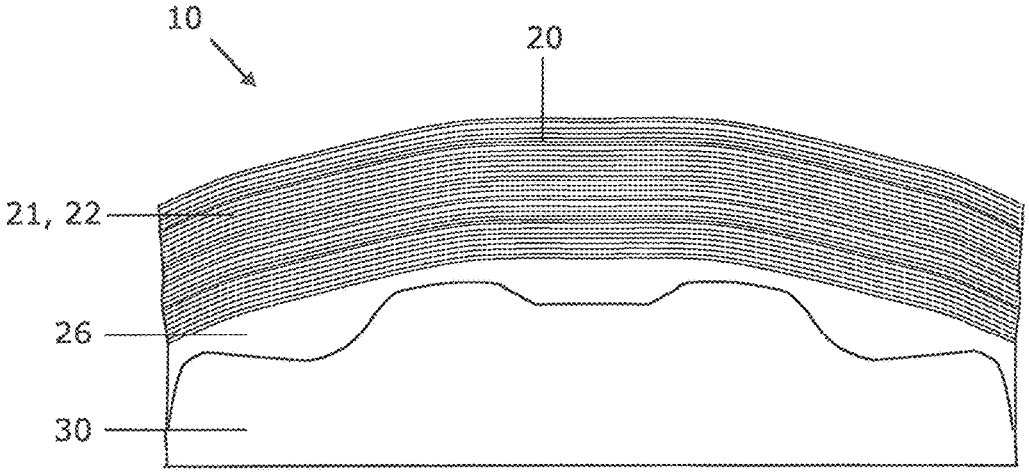
FIG. 6B shows a schematic longitudinal cross-section view of an example of a PCD element.

With reference to FIG. 6B, an example of a PCD element 10 comprises a PCD structure 20 comprising a plurality of alternating strata 21, 22 formed of different respective grades of PCD material, and a portion 26 that does not comprise strata. The portion 26 may be cooperatively formed according to the shape of the non-planar end of the support body 30 to which it has integrally bonded during the treatment at the ultra-high pressure. The alternating strata 21, 22 of different grades of PCD or mixes of diamond grain sizes or grades are bonded together by direct diamond-to-diamond intergrowth to form an integral, solid and stratified PCD structure 20. The shapes of the PCD strata 21, 22 may be curved, bowed or distorted in some way as a result of being subjected to the ultra-high pressure. In some versions of the method, the aggregate masses may be arranged in the pre-sinter assembly to achieve various other configurations of strata within the PCD structure, taking into account possible distortion of the arrangement during the ultra-high pressure and high temperature treatment.

The strata 21, 22 may comprise different respective PCD grades as a result of the different mean diamond grain sizes of the strata. Different amounts of catalyst material may infiltrate into the different types of discs 41, 42 comprised in the pre-sinter assembly since they comprise diamond grains having different mean sizes, and consequently different sizes of spaces between the diamond grains. The corresponding alternating PCD strata 21, 22 may thus comprise different, alternating amounts of catalyst material for diamond. The content of the filler material in terms of volume percent within the tensioned region may be greater than that within each of the compressed regions.

In one example, the compressed strata may comprise diamond grains having mean size greater than the mean size of the diamond grains of the tensioned strata. For example, the mean size of the diamond grains in the tensioned strata may be at most about 10 microns, at most about 5 microns or even at most about 2 microns, and at least about 0.1 microns or at least about 1 micron. In some embodiments, the mean size of the diamond grains in each of the compressed strata may be at least about 5 microns, at least about 10 microns or even at least about 15 microns, and at most about 30 microns or at most about 50 microns.

Whilst not wishing to be bound by a particular theory, when the stratified PCD structure is allowed to cool from the high temperature at which it was formed, the alternating strata containing different amounts of metal catalyst material may contract at different rates. This may be because metal contracts much more substantially than diamond does as it cools from a high temperature. This differential rate of contraction may cause adjacent strata to pull against each other, thus inducing opposing stresses in them.

The PCD element 10 described with reference to FIG. 6B may be processed by grinding to modify its shape to form a PCD element substantially as described with reference to FIG. 4. This may involve removing part of some of the curved strata to form a substantially planar working surface and a substantially cylindrical side surface. Catalyst material may be removed from a region of the PCD structure adjacent the working surface or the side surface or both the working surface and the side surface. This may be done by treating the PCD structure with acid to leach out catalyst material from between the diamond grains, or by other methods such as electrochemical methods. A thermally stable region, which may be substantially porous, extending a depth of at least about 50 microns or at least about 100 microns from a surface of the PCD structure, may thus be provided. Some embodiments with 50 to 80 micron thick layers in which this leach depth is around 250 microns have been shown to exhibit substantially improved performance, for example a doubling in performance after leaching over an unleached PCD product. In one example, the substantially porous region may comprise at most 2 weight percent of catalyst material.

The use of alternating layers or strata with different grain sizes through, for example, differences in binder content, may controllably give a different structure when acid leaching is applied to the PCD construction 10, especially for the embodiments in which the binder does not contain V and/or Ti. Such a structure may be created as a result of different residual tungsten in each layer during HCl acid leaching. In essence, the rate of leaching is likely to be different in each layer (unless HF-containing acid is used) and this may enable preferential leaching especially at the edges of the PCD material. This may be more pronounced for layers thicker than 120 microns. This is unlikely to occur if HF acid leaching were applied to the PCD material. The reason for this is that, in such a process, the HCl acid removes Co and leaves behind tungsten, whilst HF acid leaching would remove everything in the binder composition.

Figure 7A:
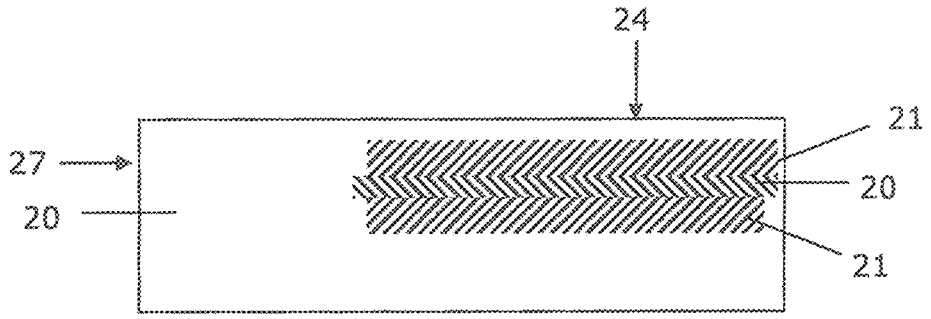
FIG. 7A, FIG. 7B, FIG. 7C and FIG. 7D show schematic cross-section views of parts of examples of PCD structures.

With reference to FIG. 7A, an example variant of a PCD structure 20 comprises at least three substantially planar strata 21, 22 strata arranged in an alternating configuration substantially parallel to a working surface 24 of the PCD structure 20 and intersecting a side surface 27 of the PCD structure.

Figure 7B:
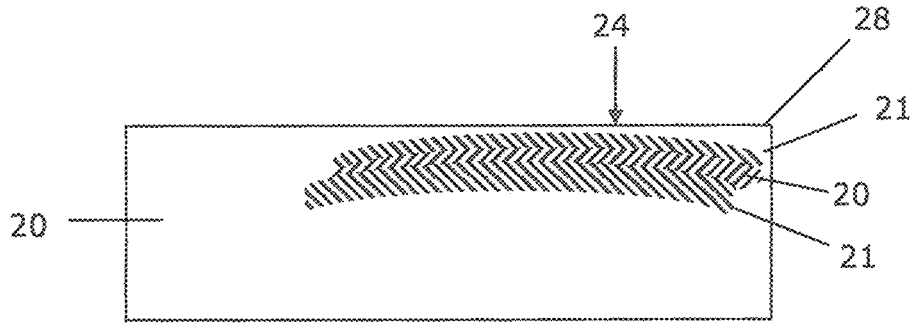

With reference to FIG. 7B, an example variant of a PCD structure 20 comprises at least three strata 21, 22 strata arranged in an alternating configuration, the strata having a curved or bowed shape, with at least part of the strata inclined away from a working surface 24 and cutting edge 28 of the PCD structure.

Figure 7C:
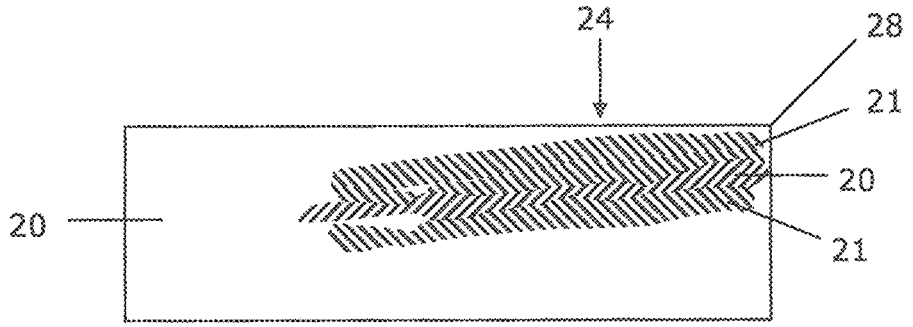

With reference to FIG. 7C, an example variant of a PCD structure 20 comprises at least three strata 21, 22 strata arranged in an alternating configuration, at least part of the strata inclined away from a working surface 24 of the PCD structure and extending generally towards a cutting edge 28 of the PCD structure.

Figure 7D:
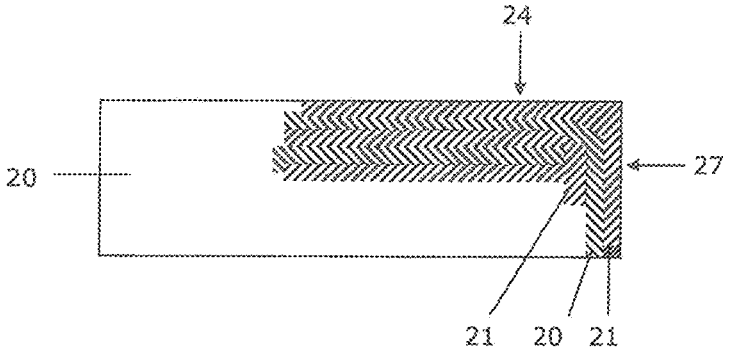

With reference to FIG. 7D, an example variant of a PCD structure 20 comprises at least three strata 21, 22 strata arranged in an alternating configuration, at least part of some of the strata being substantially aligned with a working surface 24 of the PCD structure and at least part of some of the strata generally aligned with a side surface 27 of the PCD structure. Strata may be generally annular of part annular and substantially concentric with a substantially cylindrical side surface 27 of the PCD structure 20.

The PCD structure may have a surface region proximate a working surface, the region comprising PCD material having a Young's modulus of at most about 1,050 MPa, or at most about 1,000 MPa. The surface region may comprise thermally stable PCD material.

Some examples of PCD structures may have at least 3, at least 5, at least 7, at least 10 or even at least 15 compressed regions, with tensioned regions located between them.

Each stratum or layer may have a thickness of at least about 30 microns, at least about 100 microns, or at least about 200 microns. Each stratum or layer may have a thickness of at most about 300 microns or at most about 500 microns. In some example embodiments, each stratum or layer may have a thickness of at least about 0.05 percent, at least about 0.5 percent, at least about 1 percent or at least about 2 percent of a thickness of the PCD structure measured from a point on a working surface at one end to a point on an opposing surface. In some embodiments, each stratum or layer may have a thickness of at most about 5 percent of the thickness of the PCD structure.

As used herein, the term "residual stress state" refers to the stress state of a body or part of a body in the absence of an externally-applied loading force. The residual stress state of a PCD structure, including a layer structure may be measured by means of a strain gauge and progressively removing material layer by layer. In some examples of PCD elements, at least one compressed region may have a compressive residual stress of at least about 50 MPa, at least about 100 MPa, at least about 200 MPa, at least about 400 MPa or even at least about 600 MPa. The difference between the magnitude of the residual stress of adjacent strata may be at least about 50 MPa, at least about 100 MPa, at least about 200 MPa, at least about 400 MPa, at least about 600 MPa, at least about 800 MPa or even at least about 1,000 MPa. In one example, at least two successive compressed regions or tensioned regions may have different residual stresses. The PCD structure may comprise at least three compressed or tensioned regions each having a different residual compressive stress, the regions arranged in increasing or decreasing order of compressive or tensile stress magnitude, respectively.

In one example, each of the regions may have a mean toughness of at most 16 $MPa \cdot m^{1/2}$. In some embodiments, each of the regions may have a mean hardness of at least about 50 GPa, or at least about 60 GPa. Each of the regions may have a mean Young's modulus of at least about 900 MPa, at least about 950 MPa, at least about 1,000 or even at least about 1,050 MPa.

As used herein, "transverse rupture strength" (TRS) is measured by subjecting a specimen in the form of a bar having width W and thickness T to a load applied at three positions, two on one side of the specimen and one on the opposite side, and increasing the load at a loading rate until the specimen fractures at a load P. The TRS is then calculated based on the load P, dimensions of the specimen and the span L, which is the distance between the two load positions on one side. Such a measurement may also be referred to as a three-point bending test and is described by D. Munz and T. Fett in "Ceramics, mechanical properties, failure behaviour, materials selection" (1999, Springer, Berlin). The TRS corresponding to a particular grade of PCD material is measured measuring the TRS of a specimen of PCD consisting of that grade.

While the provision of a PCD structure with PCD strata having alternating compression and tensile stress states tends to increase the overall effective toughness of the PCD structure, this may have the effect of increasing the potential incidence of de-lamination, in which the strata may tend to come apart. While wishing not to be bound by a particular theory, de-lamination may tend to arise if the PCD strata are not sufficiently strong to sustain the residual stress between them. This effect may be ameliorated by selecting the PCD grades, and the PCD grade of which the tensioned region in particular is formed, to have sufficiently high TRS. The TRS of the PCD grade or grades of which the tensioned region is formed should be greater than the residual tension that it may experience. One way of influencing the magnitude of the stress that a region may experience is by selecting the relative thicknesses of adjacent regions. For example, by selecting the thickness of a tensioned region to be greater than that of the adjacent compressive regions is likely to reduce the magnitude of tensile stress within the tensioned region.

The residual stress states of the regions may vary with temperature. In use, the temperature of the PCD structure may differ substantially between points proximate a cutting edge and points remote from the cutting edge. In some uses, the temperature proximate the cutting edge may reach several hundred degrees centigrade. If the temperature exceeds about 750 degrees centigrade, diamond material in the presence of catalyst material such as cobalt is likely to convert to graphite material, which is not desired. Therefore, in some uses, the alternating stress states in adjacent regions as described herein should be considered at a temperature of up to about 750 degrees centigrade.

The $K_1C$ toughness of a PCD disc is measured by means of a diametral compression test, which is described by Lammer ("Mechanical properties of polycrystalline diamonds", Materials Science and Technology, volume 4, 1988, p. 23.) and Miess (Miess, D. and Rai, G., "Fracture toughness and thermal resistances of polycrystalline diamond compacts", Materials Science and Engineering, 1996, volume A209, number 1 to 2, pp. 270-276).

Young's modulus is a type of elastic modulus and is a measure of the uni-axial strain in response to a uni-axial stress, within the range of stress for which the material behaves elastically. A preferred method of measuring the Young's modulus E is by means of measuring the transverse and longitudinal components of the speed of sound through the material, according to the equation $E=2\rho \cdot C_T^2(1+\nu)$, where $\nu=(1-2\ (C_T/C_L)^2)/(2-2\ (C_T/C_L)^2)$, $C_L$ and $C_T$ are respectively the measured longitudinal and transverse speeds of sound through it and $\rho$ is the density of the material. The longitudinal and transverse speeds of sound may be measured using ultrasonic waves, as is well known in the art. Where a material is a composite of different materials, the mean Young's modulus may be estimated by means of one of three formulas, namely the harmonic, geometric and rule of mixtures formulas as follows: E=1/

$(f_1/E_1+f_2/E_2))$; $E=E_1^{f1}+E_1^{f2}$; and $E=f_1E_1+f_2E_2$; in which the different materials are divided into two portions with respective volume fractions of $f_1$ and $f_2$, which sum to one.

As used herein, the expression "formed of" means "consists of, apart from possible minor or non-substantial deviations in composition or microstructure".

The following clauses set out some of the possible combinations envisaged by the disclosure:

1. A PCD structure comprising a first layer or strata, a second layer or strata and a third layer or strata; the second layer or strata disposed between and bonded to the first and third layers or strata by intergrowth of diamond grains; each layer or strata being formed of a respective PCD grade or grades having a TRS of at least 1,200 MPa or at least 1,600 MPa; the PCD grade or grades comprised in the second layer or strata having a higher coefficient of thermal expansion (CTE) than the respective PCD grades of the first and third layers or strata. The second layer or strata may comprise a PCD grade or grades having a CTE of at least $4\times10^{-6}$ mm/° C.
2. A PCD structure comprising a first and a third layer or strata, each in a respective state of residual compressive stress, and a second layer or strata in a state of residual tensile stress and disposed between the first and third layer or strata; the first, second and third layers or strata each formed of one or more respective PCD grades and directly bonded to each other by intergrowth of diamond grains; the PCD grades having transverse rupture strength (TRS) of at least 1,200 MPa.
3. A PCD structure comprising a first layer or strata, a second layer or strata and a third layer or strata; the second layer or strata being disposed between and bonded to the first and third layers or strata by intergrowth of diamond grains; each region formed of one or more respective PCD grades comprising at least 85 volume percent diamond grains having a mean size of at least 0.1 micron and at most 30 micron; the PCD grade or grades comprised in the second layer or strata containing a higher content of metal than is contained in each of the respective PCD grades comprised in the first and in the third layers or strata. The PCD grade or grades comprised in the second layer or strata may contain at least 9 volume percent metal.
4. A PCD structure comprising a first layer or strata, a second layer or strata and a third layer or strata; the second layer or strata being disposed between and bonded to the first and third layers or strata by intergrowth of diamond grains; each layer or strata being formed of one or more respective PCD grades having a TRS of at least 1,200 MPa; the PCD grade or grades comprised in the second layer or strata containing more metal than is contained in each of the respective PCD grades comprised in the first and in the third layers or strata. The PCD grade or grades comprised in the second layer or strata may contain at least 9 volume percent metal.
5. In all of the combinations above numbered from 1 to 4, the PCD structure may comprise a thermally stable region extending a depth of at least 50 microns from a surface of the PCD structure; in which the thermally stable region comprises at most 2 weight percent of catalyst material for diamond.
6. In all of the combinations above numbered from 1 to 5, the layers or strata may be in the form of strata arranged in an alternating configuration to form an integral, stratified PCD structure. The strata may have thickness of at least about 10 microns and at most about 500 microns, and the strata may be generally planar, curved, bowed or domed.
7. In all of the combinations above numbered from 1 to 6, the layers or strata may intersect a working surface or side surface of the PCD structure. The PCD grade or grades comprised in the first and third layers or strata may comprise diamond grains having a different mean size than the diamond grains comprised in the second layer or strata.
8. In all of the combinations above numbered from 1 to 7, the volume or thickness of the second layer or strata may be greater than the volume or thickness of the first layer or strata and the volume or thickness of the third layer or strata.

A PCD element comprising a PCD structure bonded to a cemented carbide support body can be provided. The PCD element may be substantially cylindrical and have a substantially planar working surface, or a generally domed, pointed, rounded conical or frusto-conical working surface. The PCD element may be for a rotary shear (or drag) bit for boring into the earth, for a percussion drill bit or for a pick for mining or asphalt degradation.

PCD elements as described herein have the aspect of enhanced resistance to fracture.

A non-limiting example PCD element comprising alternating strata of two different grades of PCD was provided as follows.

First and second sheets, each containing diamond grains having a different mean size and held together by an organic binder were made by the tape casting method. This method involved providing respective slurries of diamond grains suspended in liquid binder, casting the slurries into sheet form and allowing them to dry to form self-supportable diamond-containing sheets. The mean size of the diamond grains within the first sheet was in the range from about 5 microns to about 14 microns, and the mean size of the diamond grains within the second sheet was in the range from about 18 microns to about 25 microns. Both sheets also contained about 3 weight percent vanadium carbide and about 1 weight percent cobalt. After drying, the sheets were about 0.12 mm thick. Fifteen circular discs having diameter of about 18 mm were cut from each of the sheets to provide first and seconds sets of disc-shaped wafers.

A support body formed of cobalt-cemented tungsten carbide was provided. The support body was generally cylindrical in shape, having a diameter of about 18 mm and a non-planar end formed with a central projecting member. A metal cup having an inner diameter of about 18 mm was provided for assembling a pre-sinter assembly. The diamond-containing wafers were placed into the cup, alternately stacked on top of each other with discs from the first and second sets inter-leaved. A layer of loose diamond grains having a mean size in the range from about 18 microns to about 25 microns was placed into the upturned cup, on top of the uppermost of the wafers, and the support body was inserted into the cup, with the non-planar end pushed against the layer.

The pre-sinter assembly thus formed was assembled into a capsule for an ultra-high pressure press and subjected to a pressure of about 6.8 GPa and a temperature of at least about 1,450 degrees centigrade for about 10 minutes to sinter the diamond grains and form a PCD element comprising a PCD structure bonded to the support body.

The PCD element was processed by grinding and lapping to form a cutter element having a substantially planar working surface and cylindrical side, and a 45 degree chamfer between the working surface and the side. The cutter element was subjected to a turret milling test in which it was used to cut a body of granite until the PCD structure fractured or became so badly worn that effective cutting could no longer be achieved. At various intervals, the test was paused to examine the cutter element and measure the size of the wear scar that had formed into PCD structure as a result of the cutting. The PCD cutter exhibited better wear resistance and fracture resistance that would be expected from a PCD material having the aggregate, non-stratified microstructure and properties of the component grades.

A cross-section through the PCD structure was also examined micro-structurally by means of a scanning electron microscope (SEM). PCD strata were clearly evident, each stratum having thickness in the range from about 50 microns to about 70 microns.

Figure 8:
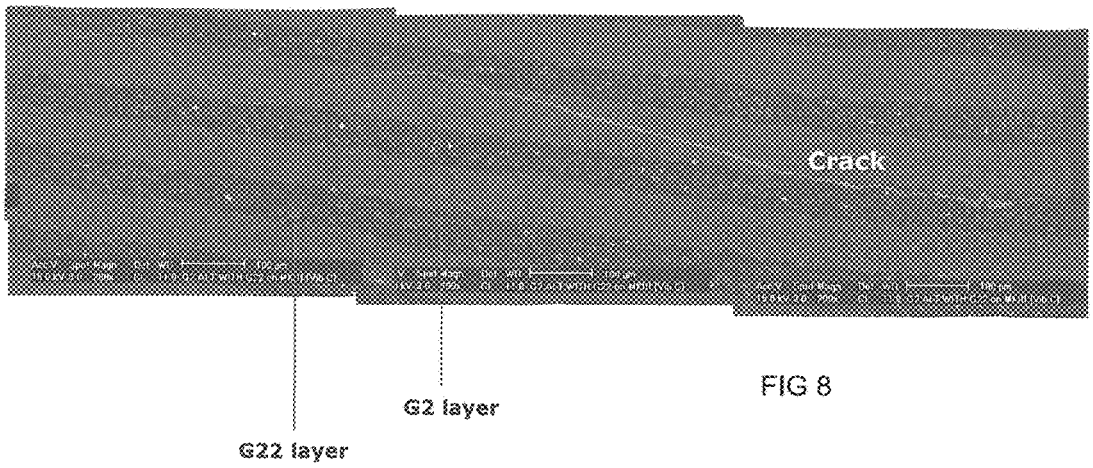
FIG. 8 is an SEM image of a cross-section through a PCD structure of one embodiment which has been subjected to a vertical borer test.

A PCD structure so formed was separately subjected to a vertical borer test which is an application-based test where the wear flat area (or amount of PCD worn away during the test) is measured as a function of the number of passes of the cutter element boring into the work piece, which equates to a volume of rock removed. The work piece in this case was granite. This test can be used to evaluate cutter behaviour during drilling operations. An SEM image was taken of a cross-section through the PCD structure after it had been subjected to the vertical borer test and the SEM image is shown in FIG. 8. It will be seen that a crack has propagated through the PCD structure but has been deflected and contained within adjacent alternating layers. It is therefore believed that the alternating layer configuration described herein may assist in inhibiting spalling.

Various modifications will be appreciated to the embodiments described which are not intended to be limiting. For example, whilst the subsequent processing of the PCD element 10 such as leaching to remove catalyst material therefrom has been described with reference to the embodiment shown in FIG. 6B, such processing techniques could be applied to any of the embodiments.

What is claimed is:

1. A PCD structure comprising a first region and a second region adjacent the first region, the second region being bonded to the first region by intergrowth of diamond grains; the first region comprising a plurality of alternating strata or layers, each stratum or layer having a thickness in the range of around 5 to 300 microns; the second region comprising a plurality of strata or layers, one or more strata or layers in the second region having a thickness greater than the thicknesses of the individual strata or layers in the first region, wherein the alternating layers or strata in the first region comprise first layers or strata alternating with second layers or strata, the first layers or strata being in a state of residual compressive stress and the second layers or strata being in a state of residual tensile stress.

2. A PCD structure according to claim 1, wherein each stratum or layer in the first region has a thickness in the range of around 30 to 300 microns.

3. A PCD structure according to claim 1, wherein the strata or layers in the first region have a thickness or thicknesses in the range of around 30 to 200 microns.

4. A PCD structure according to claim 1, wherein the strata or layers in the second region have a thickness of greater than around 200 microns.

5. A PCD structure according to claim 1, wherein the first region comprises two or more different average diamond grain sizes.

6. A PCD structure according to claim 1, wherein the first region comprises three of more different average diamond grain sizes.

7. A PCD structure comprising a first region and a second region adjacent the first region, the second region being bonded to the first region by intergrowth of diamond grains; the first region comprising a plurality of alternating strata or layers, each layer or stratum in the first region having a thickness in the range of around 5 to 300 microns; the first region comprising two or more different average diamond grain sizes.

8. A PCD structure according to claim 1, wherein the first region comprises an external working surface forming the initial working surface of the PCD structure in use.

9. A PCD structure according to claim 7, wherein the second region has a thickness greater than the thickness of the individual strata or layers in the first region.

10. A PCD structure according to claim 7, wherein the second region comprises a plurality of layers or strata.

11. A PCD structure according to claim 7, wherein the alternating layers or strata comprise first layers or strata alternating with second layers or strata, the first layers or strata being in a state of residual compressive stress and the second layers or strata being in a state of residual tensile stress.

12. A PCD structure according to claim 1, wherein the alternating layers or strata comprise first layers or strata alternating with second layers or strata, the first layers or strata being formed of a diamond mix having three or more different average diamond grain sizes and the second layers or strata being formed of a diamond mix having the same three or more average diamond grain sizes, wherein the first strata or layers in the first region have a different ratio of diamond grain sizes in said mix from the second strata or layers in the first region.

13. A PCD structure according to claim 1, wherein the alternating layers or strata comprise first layers or strata alternating with second layers or strata, the first layers or strata being formed of a diamond mix having a first average grain size or sizes and the second layers or strata being formed of a diamond mix having a second average grain size or sizes.

14. A PCD structure according to claim 1, wherein layers or strata in the first region and/or the second region comprise one or more of:

- up to 20 wt % nanodiamond additions in the form of nanodiamond powder grains;
- salt systems;
- borides or metal carbides of at least one of Ti, V, or Nb; or
- at least one of the metals Pd or Ni.

15. A PCD structure according to claim 1, wherein the PCD structure has a longitudinal axis, the layers or strata in the first region and/or the second region lying in a plane perpendicular to the plane through which the longitudinal axis of the PCD structure extends.

16. A PCD structure according to claim 1, wherein the layers or strata are planar, curved, bowed or domed.

17. A PCD structure according to claim 1, wherein the PCD structure has a longitudinal axis, the layers or strata in the first region and/or the second region lying in a plane at an angle to the plane through which the longitudinal axis of the PCD structure extends.

18. A PCD structure according to claim 1, wherein the volume of the first region is greater than the volume of the second region.

19. A PCD structure according to claim 1, wherein one or more of the strata or layers intersect a working surface or side surface of the PCD structure.

20. A PCD structure according to claim 1, wherein each strata or layer is formed of one or more respective PCD grades having a TRS of at least 1,000 MPa; the PCD grade or grades in adjacent strata or layers having a different coefficient of thermal expansion (CTE).

21. A PCD element as claimed in claim 1, wherein at least a portion of the first region is free of a catalyst material for diamond, said portion forming a thermally stable region.

22. A PCD element as claimed in claim 21, wherein the thermally stable region extends a depth of at least 50 microns from a surface of the PCD structure.

23. A PCD element as claimed in claim 21, wherein the thermally stable region comprising at most 2 weight percent of catalyst material for diamond.

24. A PCD element for a rotary shear bit for boring into the earth, or for a percussion drill bit, comprising a PCD structure as claimed in claim 1 bonded to a cemented carbide support body.

25. A drill bit or a component of a drill bit for boring into the earth, comprising a PCD element as claimed in claim 24.

* * * * *